US009125466B2

(12) United States Patent
French

(10) Patent No.: US 9,125,466 B2
(45) Date of Patent: Sep. 8, 2015

(54) BUSINESS CARD HOLDER AND DISPENSER

(71) Applicant: David J French, Gatineau (CA)

(72) Inventor: David J French, Gatineau (CA)

( * ) Notice: Subject to any disclaimer, the term of this patent is extended or adjusted under 35 U.S.C. 154(b) by 15 days.

(21) Appl. No.: 13/926,071

(22) Filed: Jun. 25, 2013

(65) Prior Publication Data

US 2014/0373412 A1 Dec. 25, 2014

(51) Int. Cl.

| | |
|---|---|
| ***A45C 11/18*** | (2006.01) |
| ***G09F 3/20*** | (2006.01) |
| *G09F 3/18* | (2006.01) |

(52) U.S. Cl.

CPC . *A45C 11/18* (2013.01); *G09F 3/20* (2013.01); *G09F 3/18* (2013.01)

(58) Field of Classification Search

CPC ..... G09F 3/18
USPC ..... 40/642.02; 224/230
See application file for complete search history.

(56) References Cited

U.S. PATENT DOCUMENTS

| | | | | |
|---|---|---|---|---|
| D324,883 | S * | 3/1992 | Demirjian | D19/90 |
| 6,082,581 | A * | 7/2000 | Anderson et al. | 221/232 |
| 2003/0217936 | A1 * | 11/2003 | Nourian | 206/39 |
| 2005/0133524 | A1 * | 6/2005 | De Laforcade | 221/65 |
| 2008/0022565 | A1 * | 1/2008 | Sandy | 40/124 |

FOREIGN PATENT DOCUMENTS

JP 2009227284 A * 10/2009

* cited by examiner

*Primary Examiner* — Gary Hoge

(57) ABSTRACT

A business card holder includes a support for containing a number of business cards permitting vertical extraction of one card from the set by grasping the card along its narrower upper edge. The lower surface of the support is bevelled so as to cause the set of cards to be presented at the upper end of the support at differing heights for ease of extraction. The upper edge of at least one wall containing the cards is lower than the top edge of all of the cards in the set, providing an edge that will permit the uppermost card to be bent slightly outward over this top edge for extraction. The vertical height of the card support when positioned within a pocket may be established by providing a downwardly extending leg that will rest against the bottom of the pocket.

8 Claims, 8 Drawing Sheets

BUSINESS CARD HOLDER AND DISPENSER

This application claims priority from a Canadian patent application CA2,781,781 filed in Canada on Jun. 26, 2012 the contents of which are adopted herein by reference.

FIELD OF THE INVENTION

This invention relates to a holder and dispenser for business cards that in one variant is adapted to be worn, providing easy access for the removal of individual business cards.

BACKGROUND TO THE INVENTION

Business cards are an important part of commercial life. People meeting for the first time exchange cards within the first few moments of their engagement, Generally, cards are carried in a pocket and in some cases in a business card holder. In the case of a business card holder it is inconvenient to use two hands in order to extract a business card. This is true particularly at receptions where one hand may already be holding a glass containing a beverage.

Business cards stored in a pocket can be accessed with one hand only. The breast pocket on a man's suit jacket is very convenient for holding cards to be accessed in this manner. However, loose cards inserted into the breast pocket generally fall deeply down into the pocket and are not readily accessible. In particular, it is not always possible to extract a single card, particularly without turning and looking to view the pocket as the card is extracted.

It would be desirable to provide a convenient holder for containing and dispensing business cards. This invention addresses the stated objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined in each of the individual claims which conclude this specification.

SUMMARY OF THE INVENTION

According to one aspect of the invention, a business card holder includes a support for containing a number of business cards, permitting vertical extraction of one card from the set by grasping the card along its narrower upper edge. In order to provide easier access for grasping an individual card, the lower surface of the support carrying the cards is bevelled so as to cause the set of cards to be presented at the upper end of the support at differing heights. The bevel need not be linear. It is sufficient that the lower surface of the support carrying the cards present the cards at successively increasing heights.

In use the support is preferably arranged to present the bevelled array of upper card edges to be progressively higher proceeding outwardly from the body of a wearer. The card-carrying container has an outward retaining edge on the side facing away from the set of cards and located at a height whereby the top edge of the uppermost card may be bent over this edge away from the card set. This allows the uppermost card to be separated from the set by being pinched between the thumb and forefinger of a human hand, bending the card slightly outwardly in order to achieve such separation. Thereafter, the card may be more firmly grasped for removal and presentation.

To facilitate the separation of the cards, the lower bevelled surface of the support may be stepped or include grooves or be otherwise textured on the order of the width of a business card, reducing the tendency of cards to jam along this bevelled surface. A single step may be present on the sidewall of the card container just above the termination of the bevelled support surface to present the highest card in a slightly higher position than would be its normal place in the bevelled array. The included angle of the bevelled the bottom of the card holder may be approximately 30°, or 60° above the horizontal. This included angle may be in a range that permits convenient separation of one card for removal, e.g. 35° to 75° elevated upwardly from the horizontal, more preferably 55° to 65°.

The bevelled-bottomed card-carrying support according to the invention may include side containment walls either in the form of a box or frame that permits the upper ends of all of the cards in the set to extend upwardly above the support. Alternately, the sides of the cards may be contained within sidewalls that extend for the full length of the cards or more. The upper edge of the forward/outward wall containing the face surfaces of the cards should be lower than the top edge of all of the cards in the set, including the card sitting at the lower most end of the bevel, in order to provide an edge that will permit the uppermost card to be bent slightly outward over this bending edge. While the rearward/inward wall of the support may extend to a height below the cards in the set, if such wall is higher than the cards in the set, then it should include a cut-out in such wall that will allow cards to be accessed by a human thumb.

The business card support is intended to be worn on the clothing of the user and means is provided for coupling the card carrier to such clothing. This card carrier is not restricted to use in association with a pocket, although that is a preferred embodiment. In a simplest form, a fabric attachment means may be in the form of a pin. Alternately, as described further below, a magnet may be employed to effect attachment to the user's clothing.

In the case where the support is positioned within the breast pocket of a man's suit jacket, it's a vertical height with respect to the pocket may be established by providing an attachment to the pocket in the form of a clip that will engage with the upper edge of a pocket. Alternately, the support may include a downwardly extending leg, preferably in the form of a plate. The length of the leg is sufficient so that its bottom may rest against the bottom of the pocket. While this plate may be slidingly attached to the support to allow for height adjustment, it may also be fixed to the support with provision in the form of grooves serving as breakaway lines fanned transversely across the leg whereby small portions of the leg may be progressively broken away to adjust its length. All of these configurations are suitable for positioning the support vertically within a pocket on a user's clothing with the card support inside the pocket.

The card dispensing support of the invention may also be positioned outside of a pocket. Attachment means for coupling to the clothing of a user may be in the form of a clip present on one face-side of the support that fits over and engages with the upper edge of a pocket. In this case, the clip will pass into the interior of the pocket. Also, a pin located inside the pocket can pass through the fabric and engage with the side of the card-carrying container.

As a further variant, the support may include a magnetic material and a magnet may be employed to a fix the card support with respect to a user's clothing. With the cardholder on the outer surface of such clothing the magnet may be placed inside an adjacent pocket or other fabric of a wearer with or without a pocket present. The magnet is positioned with its magnetic field extending through the fabric surface to engage with the magnetic material on the support. In this variant, the support itself may be made of magnetizeable material such as sheet iron or magnetizeable stainless steel or, if made of plastic or aluminium, may include a magnetizeable portion.

The support may be made of a polymeric plastic material suitable for injection molding. Alternately, it may be made of a sheet material, such as aluminium, brass, iron or steel which may be bent into the required form to contain and present the set of business cards.

In the case where the card support itself or a clip associated with the support is presented on the outside surface of a pocket or fabric portion of a user's clothing, a card-carrying frame may be carried by the support or clip on the outward side. This frame is preferably oriented for presenting a name card in landscape mode to be viewed by others. The frame may be dimensioned to receive standard business cards as a name card, or special name cards may be printed for fitting into the frame. Optionally, the name cards may have the same width as a business card for storage within the card carrier along with the business cards, but have a greater length so that when stored with the business cards as outer members of the set, the name cards will serve to protect the business cards from being soiled. As a further option, a transparent sheet of similar dimensions may be used as a window behind which any of a variety of specially printed name cards may be displayed.

The business card support of the invention may also be provided with a detachable base for presenting the support on a surface such as that of the desk. Taking into account the inclined orientation of the business cards, the base preferentially extends beneath the support which is inclined at an angle so that the cards overlie the base. In this configuration the bending force of removing a single card is resisted by the base with a reduced tendency for the support to twist or tip over.

In a case where a magnet is provided with the card carrier, the magnet can be used to retain the card support in position on an upwardly-extending flanged portion of the base which permits the magnetic field to engage with the card support through such flange.

The foregoing summarizes the principal features of the invention and some of its optional business card holder by the description of the preferred embodiments, in conjunction with the drawings, which now follow.

Wherever ranges of values are referenced within this specification, sub-ranges therein are intended to be included within the scope of the invention unless otherwise indicated or are incompatible with such other variants. Where characteristics are attributed to one or another variant of the invention, unless otherwise indicated, such characteristics are intended to apply to all other variants of the invention where such characteristics are appropriate or compatible with such other variants.

DESCRIPTION OF THE PREFERRED EMBODIMENTS

Figure 2:
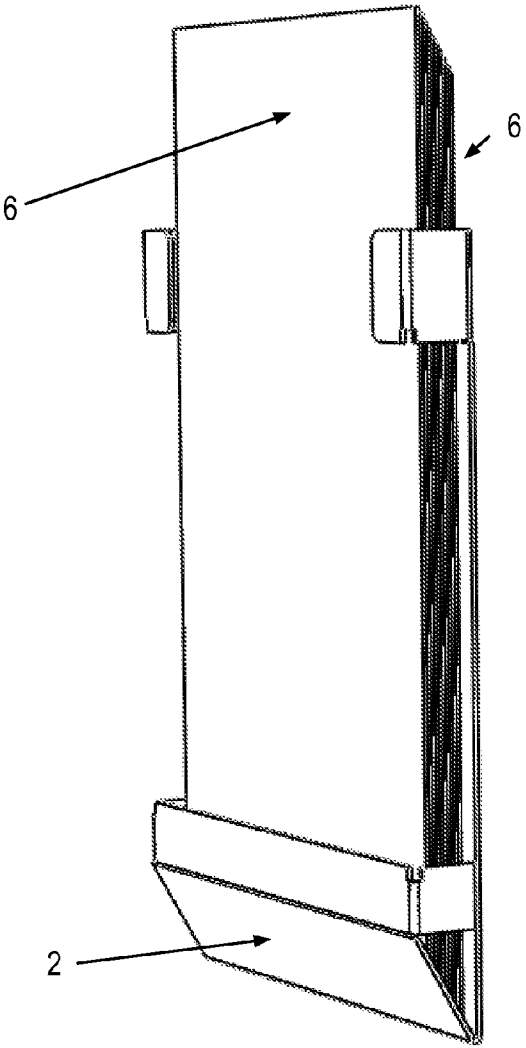
FIG. 2 is the same as FIG. 1 with business cards present within the support.
Figure 1:
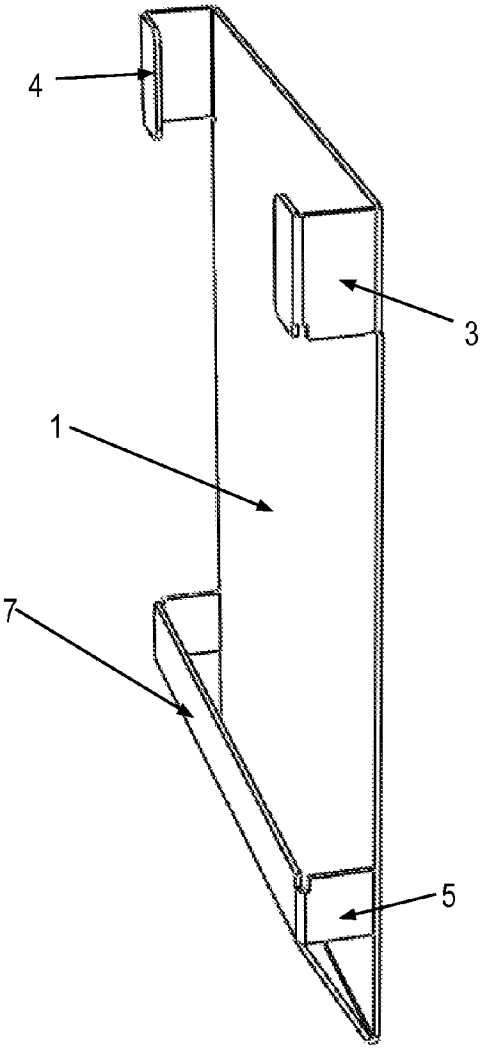
FIG. 1 is a front quarter perspective view of a first version of the support according to the invention formed of sheeting material such sheet metal.

In FIG. 1 a business card carrying support 1 according to the invention is formed of a sheet material wherein the lower surface 2 of the support 1 is bevelled so as to cause a set of cards 6, shown in FIG. 2, to be presented at the upper end of the support 1 at differing heights. The angle of the bevel measured upwardly from the horizontal may be approximately 60° or in a range that permits convenient separation of one card for removal, e.g. 35° to 75° upwardly from the horizontal.

In FIG. 1 short side containment walls 3 with front flanges 4 are present to retain the top portion of a set of cards 6. Short bottom side panels 5 provide lateral support to the bottom portion of a set of cards 6. As shown, a retaining plate 7 extends between the bottom side panels 5 to hold the bottom edge of a set of cards in place above the bevelled lower surface 2

Figure 8:
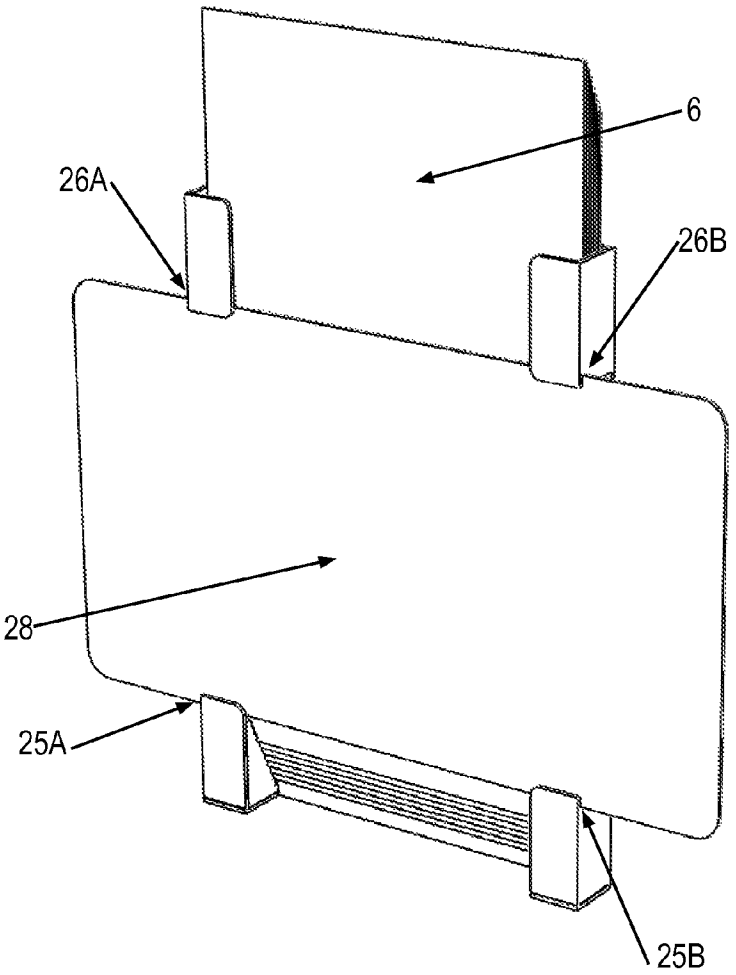
FIG. 8 is a front quarter perspective view of a variant on the support of FIG. 1 carrying a name tag wherein the lower bevelled surface is provided by two short bevelled edge surfaces located on either side of the base of the support.
Figure 9:
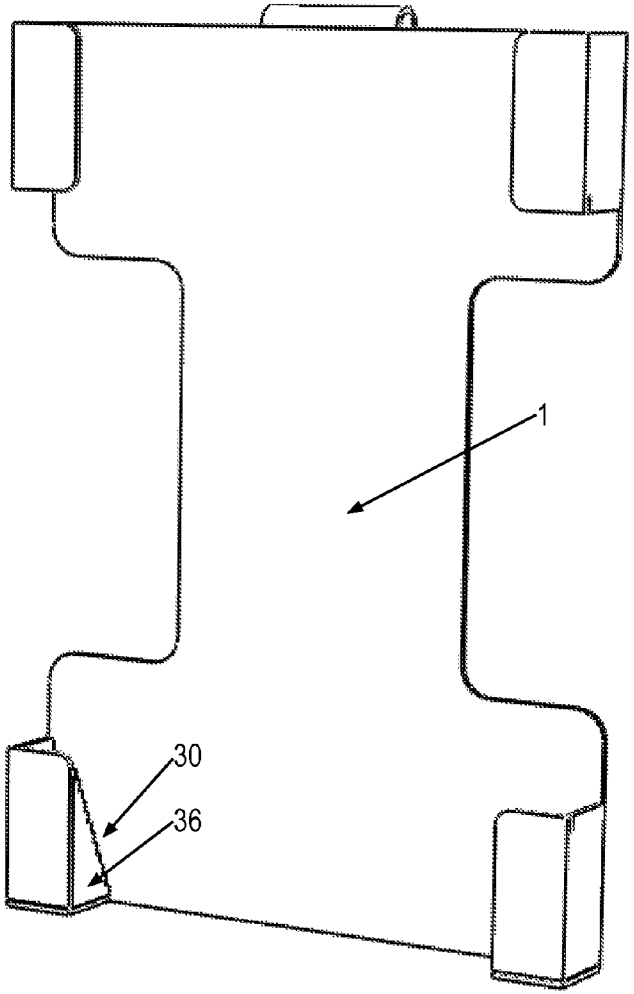
FIG. 9 is the support of FIG. 8 without business cards or name card and depicting two short inserted blocks located on either side of the base of the support which provide two bevelled, stepped, bottom support surfaces for the business cards.
Figure 8A:
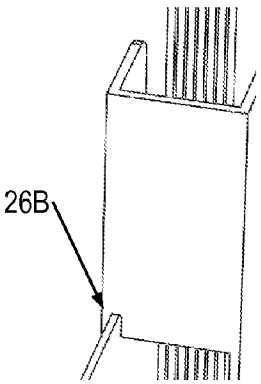
FIG. 8A is a partial close-up view of the engagement between the name card of FIG. 8 and the support along the upper edge of the name card.
Figure 8B:
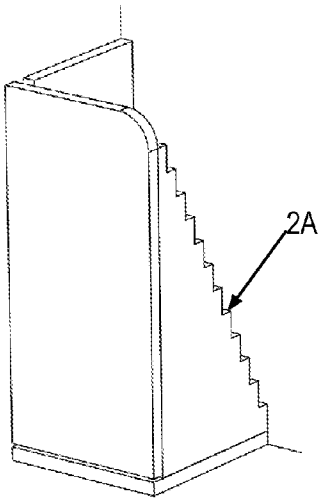
FIG. 8B is an enlarged view of the short bevelled surface of FIG. 8 showing that the bevelled surface is textured by steps.
Figure 9A:
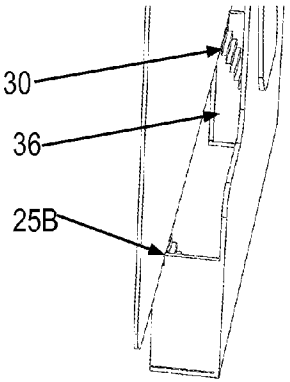
FIG. 9A is a partial close-up view of the engagement between a name card and the support along the lower edge of the name card and also showing bevelled bottom support blocks with steps for carrying cards as referenced in FIG. 9.

To facilitate the separation of the cards, the lower bevelled surface 2 of the support 1 may be stepped or include grooves 30 as shown in FIGS. 8B and 9A to reduce the tendency of cards 6 to jam along this bevelled surface 2.

In FIG. 2 a set of cards 6 are showing positioned in the support 1.

Figure 3:
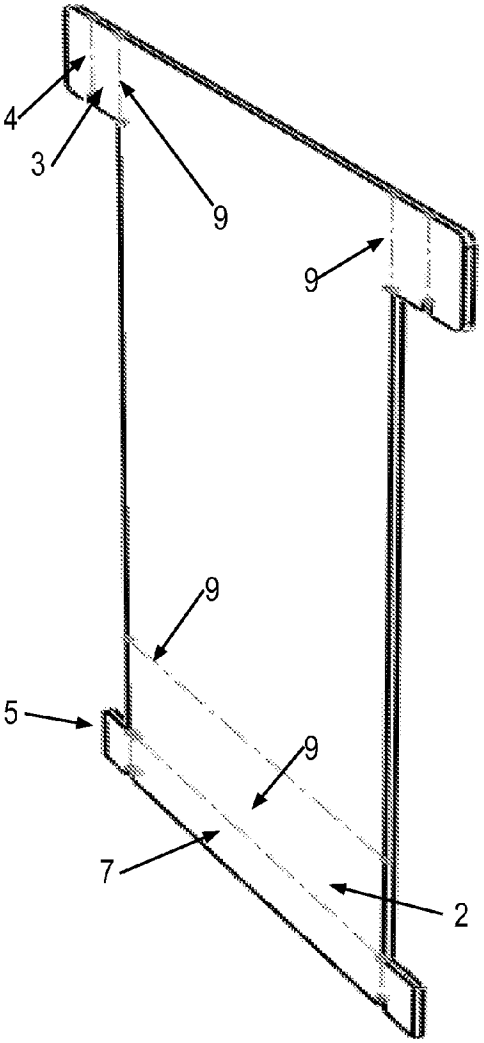
FIG. 3 is a piece of sheet metal cut and marked for bending into the form of a support as in FIG. 1.

FIG. 3 shows a cut sheet of metal 8 provided with fold lines 9 whereby the support 1 may be formed by bending along the fold lines 9.

Figure 4:
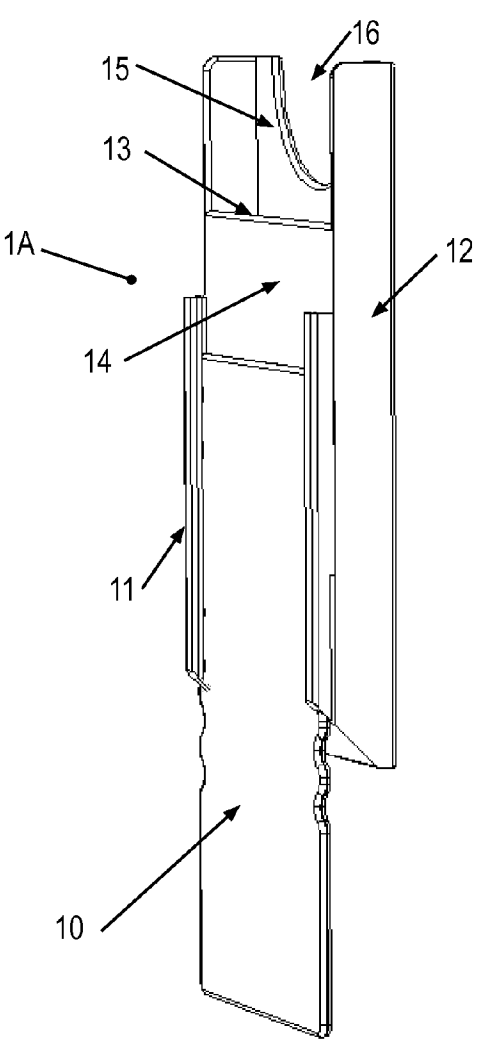
FIG. 4 is a front quarter perspective view of the support formed of thin-walled panels as by injection molding and having an adjustable leg for controlling the height of the support when positioned within a pocket.

FIG. 4 shows an alternate variation of the support 1 formed of injection moulded plastic having solid containment walls 12 and having an adjustable leg 10 that slides in locking guides 11 for controlling the height of the support 1 when positioned within a pocket.

Figure 4B:
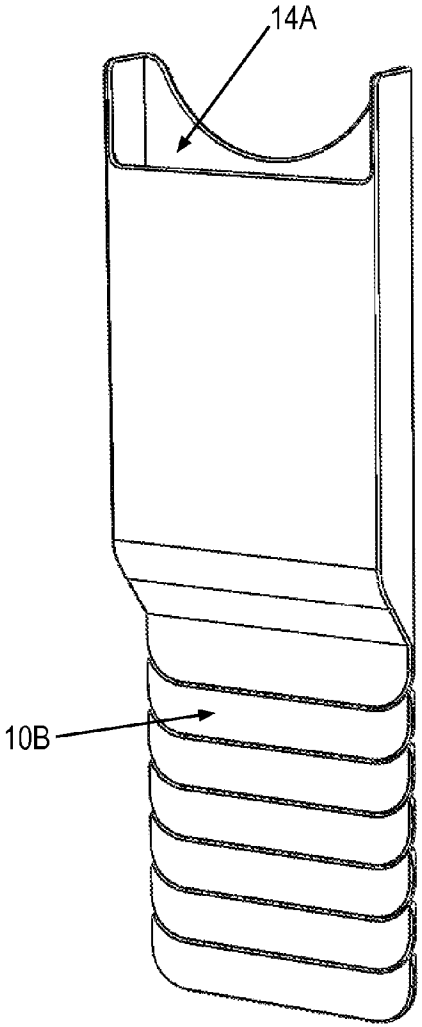
FIG. 4B is a variant on FIG. 4A with the leg on the rear face of the card support.
Figure 4A:
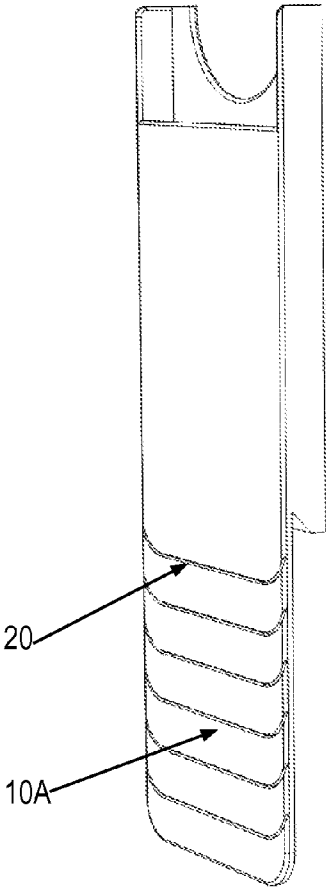
FIG. 4A is a variant on FIG. 4 with an alternate form of rigid leg with grooves serving as breakaway lines formed transversely across the leg whereby small portions of the leg may be progressively broken away to adjust its length.

In FIG. 4A an alternate form of leg 10A has grooves 20 serving as breakaway lines formed transversely across the leg 10A whereby small portions of the leg 10A may be progressively broken away to adjust its length. FIG. 4B is similar to FIG. 4A except that the leg 10B is positioned on the other side of the container for the cards in line with the rearward/inner wall 14A of the card containing box.

Figure 4E:
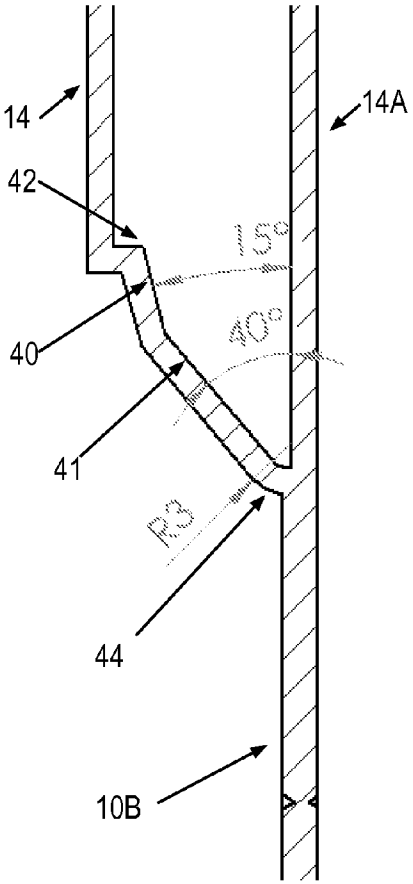
FIG. 4E is a close-up sectional view of the bevel of FIG. 4D.
Figure 4D:
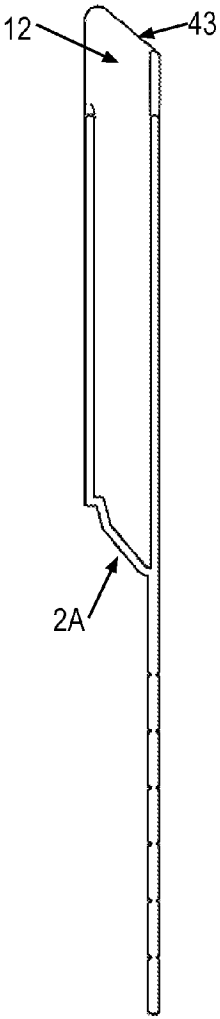
FIG. 4D is a side sectional view through FIG. 4B.
Figure 4C:
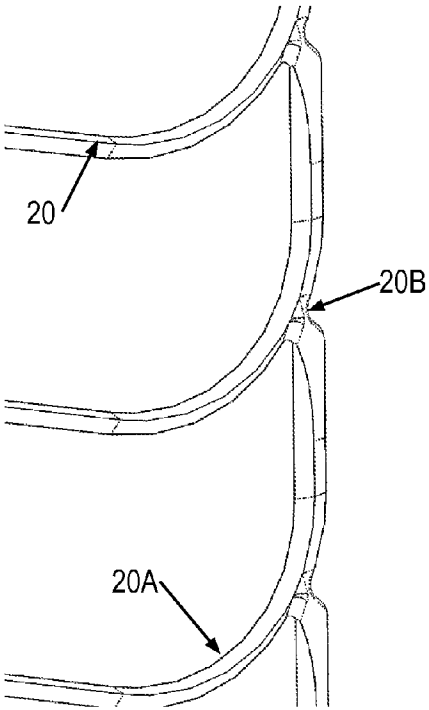
FIG. 4C is a detail of the grooves in the leg.

FIG. 4C is a detail of the grooves 20 as they run-off the leg 10B in FIG. 4B. The grooves 20 terminate in a curve 20A that optionally provides a small notch 20B that encourages the break to end in a soft corner.

In FIG. 4D the bottom bevel 2A has two features of shape shown in greater detail in the enlargement FIG. 4E. This bevel has two portions 40 and 41 that are respectively at steeper and shallower angles. At the top of the uppermost bevel 40 is a small shelf 42 which will allow a single card to stand "proud" above the rest of the cards for easier access. The shelf 42 is approximately a little larger than the thickness of a card e.g. 2×0.03 inches for some types of business cards. At the very bottom of the bevel in FIG. 4E a small radius R3 of curvature 44 avoids the pinching of the lowermost business card in a sharp corner.

In FIG. 4D the sidewall 12 has been terminated at the top with the bevel 43 which allows a user's thumb to pass more easily into the thumb slot 16.

In FIGS. 4, 4A, 4B the sides of the cards 6 may be contained within sidewalls 12 that extend for the full length of the cards and optionally even a little higher. As best seen in FIG. 4 the upper edge 13 of the forward/outward wall 14 containing the face surfaces of the cards 6 is lower than the top edge of all of the cards 6 in the set. This provides an edge 13 that will permit the uppermost card 6 to be bent slightly outward over this bending edge 13 for separation from the other cards 6 in the set. The rearward/inward wall 15 of the support 1 extends to a height equal to or above the cards 6 in the set and includes a cut-out 16 in such wall 15 that will allow cards 6 to be accessed by a human thumb. The more complete containment of cards 6 in the variants of the FIGS. 4, 4A will serve to reduce the tendency for the cards 6 to become soiled.

Figure 5:
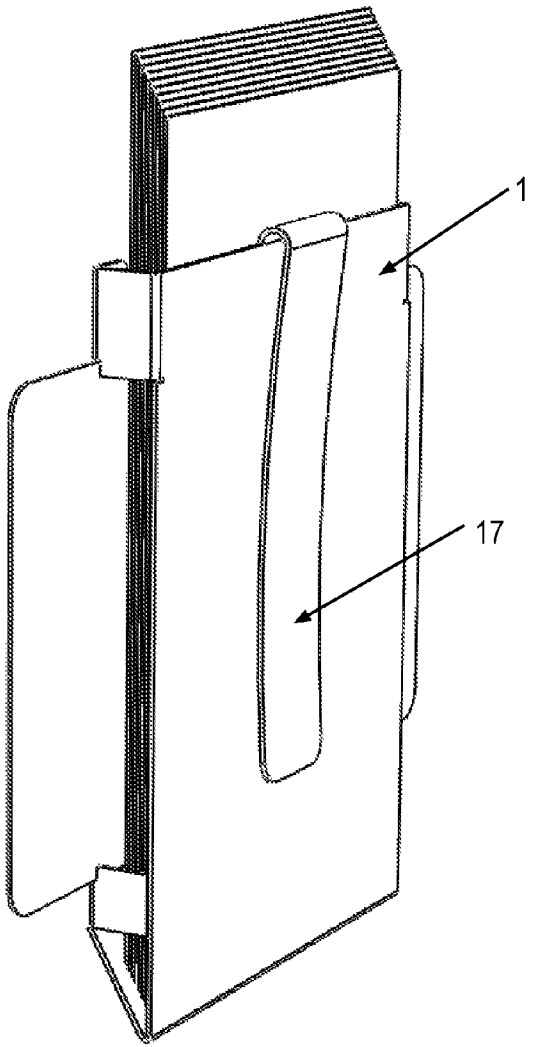
FIG. 5 is a rear quarter perspective view of the support of FIG. 1 showing a clip for engaging with the upper edge of a pocket with the card-carrying support on the outside.

In FIG. 5 the backside of the support 1 of FIG. 1 is provided with a clip 17 that will engage with the upper edge of a pocket. A similar clip could be provided in combination with the support of FIG. 4 in place of the leg 10.

Figure 6:
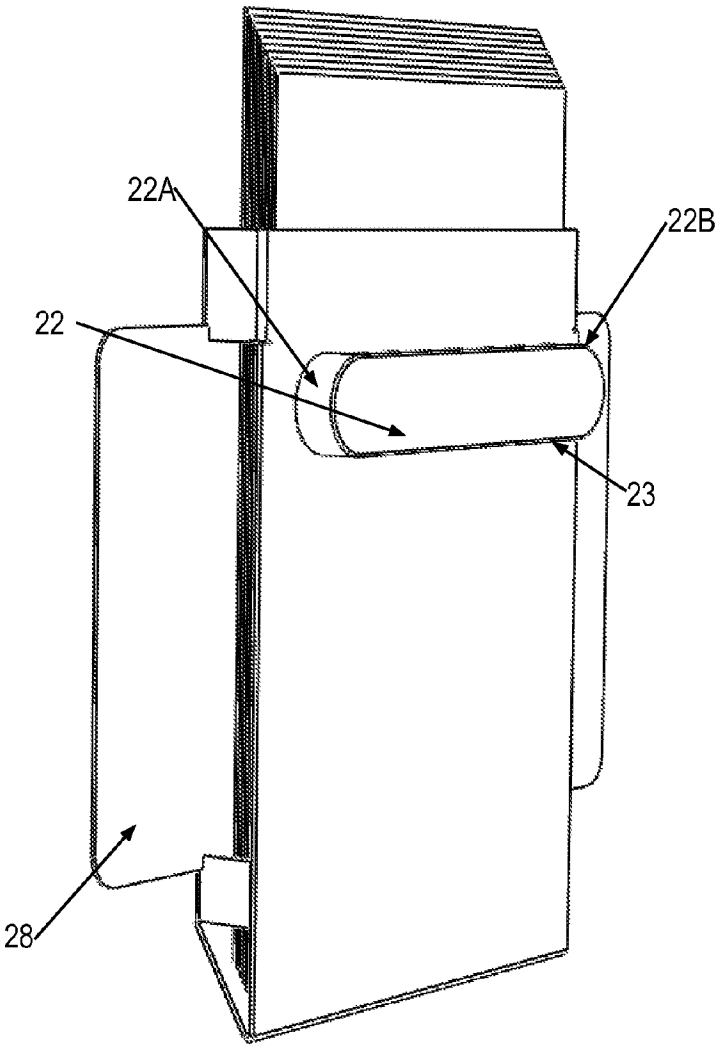
FIG. 6 is the support of FIG. 5 without the clip and having instead a twin magnet bar positioned to magnetically engage the rear surface of the support having a business card or name tag mounted on the opposite side.

In FIG. 6 the support 1 is formed of magnetic material and a magnet assembly 22 with two magnets 22A, 22B joined by a magnetically permeable bar 23 engages with the backside of the support 1. The magnets 22A, 22B replace the clip 17. Under normal use, this magnet assembly 22 is an alternate attachment system to the clip 17 wherein the magnet assembly 22 is located inside a pocket or other fabric of a wearer. From this position the magnetic field of the two magnets 22A, 22B extends through the fabric to engage with the magnetic material of the support 1.

Figure 7:
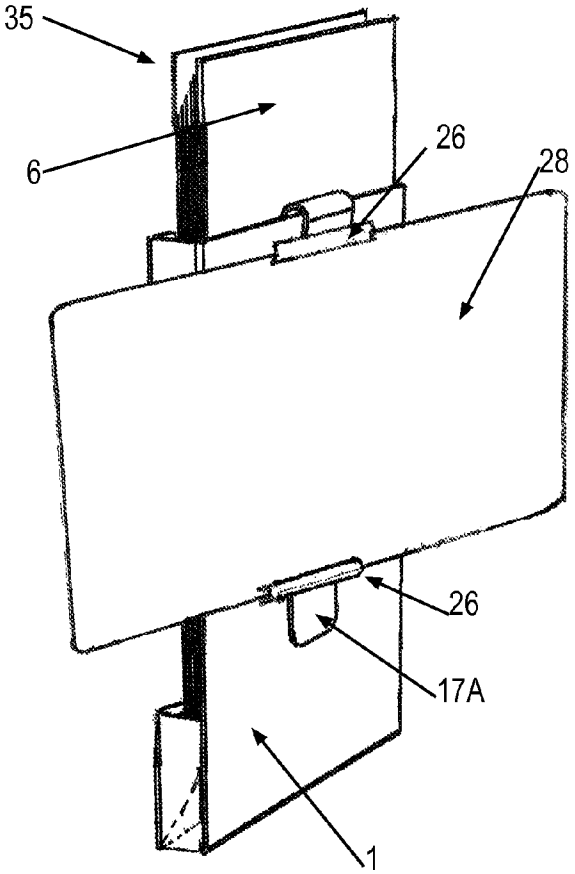
FIG. 7 is an alternate version of FIG. 6 wherein the card-carrying support is intended to be positioned inside a pocket and an outwardly extending clip includes retainers to serve as a frame for carrying a business card or name tag for outward display.

Also shown in FIG. 6 is a name card 28 further described in FIGS. 7 and 8.

In FIG. 7 an alternate form of clip 17A is mounted on the opposite face of the support 1 from that shown in FIG. 5. In the case of FIG. 7 the support 1 is intended fit inside a jacket pocket. The clip 17A which is on the outside of a jacket pocket has retainers 26 which serve as a frame for containing a name card 28. (shown as well in FIG. 8). A similar clip could be provided in combination with the support of FIG. 4 in place of the leg 10.

FIG. 7 also depicts an elongated name card or transparent window 35 in storage position with the set of business cards 6. This elongated card or window 35 has the same width as a business card 6 for storage within the card carrier along with the business cards 6, but a greater length so that when stored with the business cards 6 as an outer member of the set, the elongated name card or transparent window 35 will serve to protect the business cards 6 from being soiled as shown in FIG. 7.

In FIG. 8 the bottom bevelled surface 2 of FIG. 1 is replaced by two short bevelled surfaces 2A, 2B in the form of sheet metal edges located on either side of the bottom of the support 1. As shown in FIG. 8B these short bevelled surfaces 2A, 2B which may be stepped to serve the same function as lower surface 2 of the support 1 of FIG. 1, i.e. causing the set of cards 6 to be presented at the upper end of the support 1 at differing heights. The bevelled surfaces 2A, 2B may be reduced in width down to essentially an edge of sheet metal and still perform the same function, although with increased risk of marring a business card 6.

FIG. 8 shows a name card 28 fitted between the notches 25A, 25B, 26A, 26B which serve as hooks carried by the support 1, functioning as a card-carrying frame for display of the name card 28. The top notch 26B is shown in closer detail in FIG. 8A. A close-up of one bottom notch 25B is also shown in FIG. 9A. These notches present the name card 28 for ready visibility by others.

FIG. 9 further shows as an alternative to the bottom card support surface 2 a pair of small insert blocks 36 optionally of moulded plastic, incorporating fine steps 30 in a bevelled alignment. These steps 30, which are of the order of the thickness of a business card size, facilitate the separation of the cards 6, reducing the tendency of cards 6 to jam along this bevelled surface. These same blocks 36 with their steps 30 provide an alternative to the two short bevelled surfaces 2A, 2B located on, either side of the bottom of the support 1 as shown in FIGS. 8, 8B.

Figure 11:
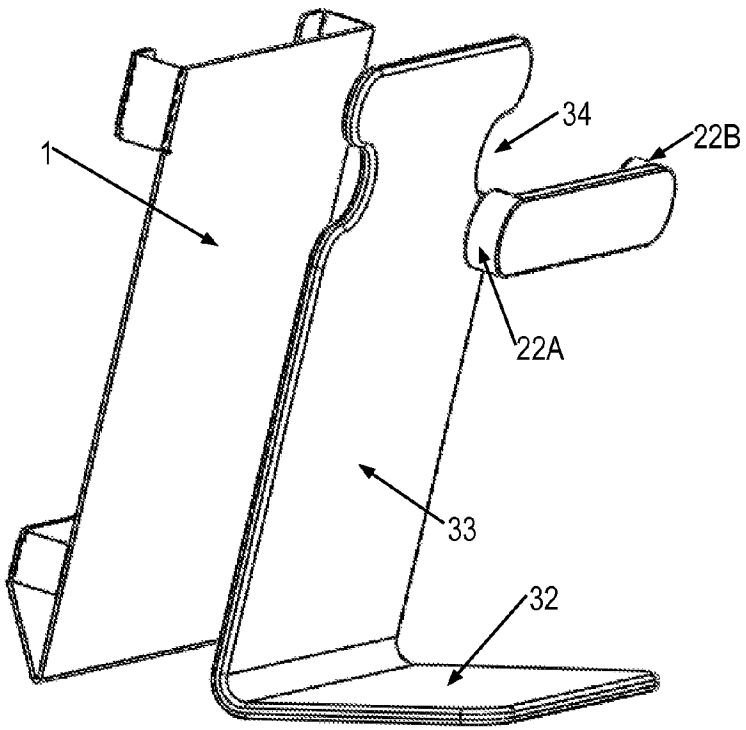
FIG. 11 is an exploded assembly view of the components of FIG. 10.
Figure 10:
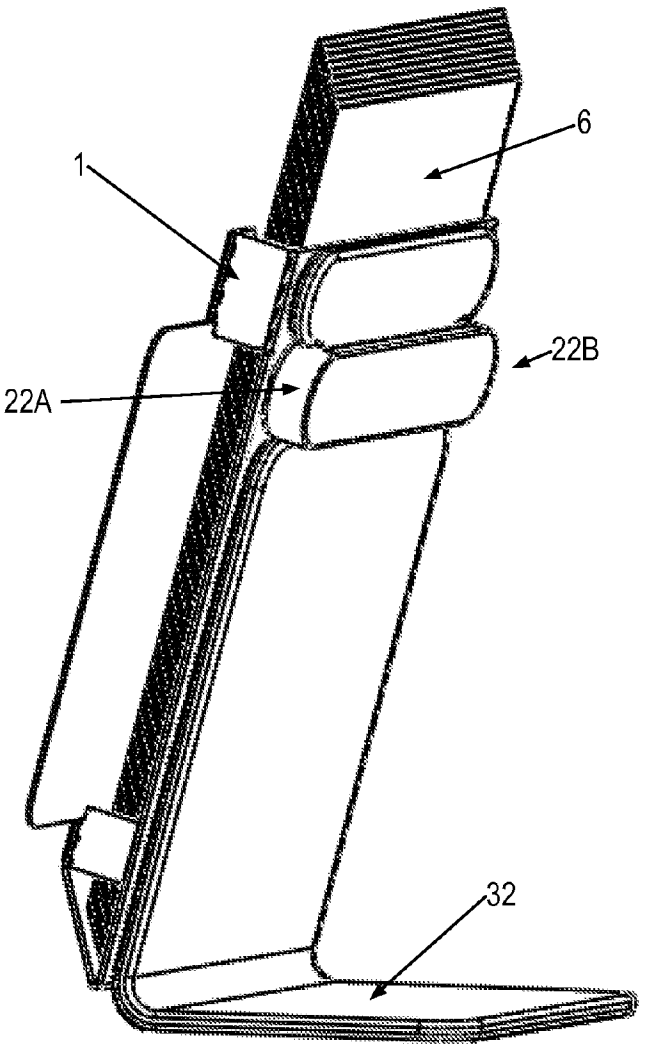
FIG. 10 depicts a rear quarter perspective view the support of FIG. 6 in an inclined position extending over and detachably mounted on an upwardly extending flange extending from a foot for positioning on a table surface, held in place by a magnet.

In FIGS. 10 and 11 the set of cards 6 are held in an inclined orientation overlying a detachable base 32 for presenting the support 1 on a surface such as that of the desk. Due to the inclined orientation of the business cards 6, the base 32 preferentially extends beneath the support 1 so that the cards 6 overlie the base 32. This provides stability for when a single card 6 is removed from the support 1.

The magnets 22A, 22B retain the card support in position on an upwardly-extending flanged portion 33 of the base 32. The magnets 22A, 22B fit into indentations 34 in the flange 33 which permit the magnetic field to more effectively engage with the card support 1. Alternately, the flange may be thin and permit the magnetic field to pass through such flange 33 to couple with the support 1.

CONCLUSION

The foregoing has constituted a description of the specific embodiments showing how the invention may be applied and put into use. These embodiments are only exemplary. The invention in its broadest, and more specific aspects, its further described and defined in the claims which now follow.

These claims, and the language used therein, are to be understood in terms of the variants of the invention which have been described. They are not to be restricted too such variants, but are to be read as covering the full scope of the invention as is implicit within the invention and the disclosure that has been provided herein.

The embodiments of the invention in which an exclusive property or privilege is claimed are defined as follows:

1. A business card holder comprising:

a) a container for a set of business cards, the container having a top end through which cards may be inserted and a lower, inner, bottom end surface that is bevelled for presenting the upper ends of cards when inserted therein at differing heights at the top end of the container to permit convenient separation of one highest card for removal, b) a leg connected in and positioned beneath the container, the leg extending downwardly from the container for bearing against the bottom of a pocket when inserted therein so as to position the top end of the container near the top end of the pocket.

2. A holder as in claim 1 wherein the container has an upper, straight, transverse edge beneath its top end positioned so as to be below the top edge of the uppermost card in the set when cards are present in the container providing an edge that will permit the uppermost card to be bent slightly outward over this upper transverse edge for removal from the support.

3. A holder as in claim 2 wherein the angle of the bevelled bottom end surface is in the range 35 degrees to 75 degrees from the horizontal to permit convenient separation of the one highest card for removal.

4. A holder as in claim 2 wherein the leg is of adjustable length.

5. A holder as in claim 4 wherein the leg has multiple grooves serving as breakaway lines formed transversely across the leg whereby small portions of the leg may be progressively broken away to adjust its length.

6. A holder as in claim 1 wherein the angle of the bevelled bottom end surface is in the range 35 degrees to 75 degrees from the horizontal to permit convenient separation of the one highest card for removal.

7. A holder as in claim 1 wherein the leg is of adjustable length.

8. A holder as in claim 7 wherein the leg has multiple grooves serving as breakaway lines formed transversely across the leg whereby small portions of the leg may be progressively broken away to adjust its length.

* * * * *